US005860717A

United States Patent [19]

Mizrahi

[11] Patent Number: 5,860,717

[45] Date of Patent: Jan. 19, 1999

[54] DRAWER STOP DEVICE

[76] Inventor: Shalom Mizrahi, 246 Lawrence Rd., Trumbull, Conn. 06611

[21] Appl. No.: 595,045

[22] Filed: Feb. 1, 1996

[51] Int. Cl.[6] ..... A47B 88/00

[52] U.S. Cl. ..... 312/322; 312/330.1

[58] Field of Search ..... 312/311, 334.45, 312/322, 334.21, 334.44, 334.19, 330.1; 16/82; 280/79.11

[56] References Cited

U.S. PATENT DOCUMENTS

| | | | |
|---|---|---|---|
| 0,426,972 | 4/1890 | Wait | 312/234.21 |
| 2,745,707 | 5/1956 | Sebens | 312/311 |
| 3,212,835 | 10/1965 | Beckett et al. | 312/311 |

FOREIGN PATENT DOCUMENTS

| | | | |
|---|---|---|---|
| 0910398 | 7/1949 | Germany | 312/322 |

OTHER PUBLICATIONS

Grass Catalog p. 69, Drawer Slide Accessories

*Primary Examiner*—Peter M. Cuomo
*Assistant Examiner*—Gerald A. Anderson
*Attorney, Agent, or Firm*—Evelyn M. Sommer

[57] ABSTRACT

A drawer stop device, for use in combination with a sliding drawer mounted in a cabinet behind a front door vertically hinged to one lateral side of the cabinet, has a mounting portion which is mounted to a portion adjacent to a vertical front edge of the drawer, a bearing portion having a bearing flange which projects perpendicularly from the mounting portion, and a roller element rotatably mounted on an end of the bearing flange such that it can make rolling contact with the door ahead of the vertical front edge when the drawer is slid out from the cabinet. This prevents the front edges of the drawer from bumping against and scratching the inside surface of the door. If the drawer is of the type wherein the ends of the front panel extend by a small amount of trim laterally beyond the side walls of the drawer, a second drawer stop device is mounted to the side walls behind the trim such that its roller element projects laterally beyond the trim so that it can make rolling contact with the door when the drawer is retracted back into the cabinet. In another version, the mounting flange of the drawer stop device is formed as an integral part of a lateral rail which is mounted to the side walls of the drawer and provides a guide surface on which the drawer slides.

5 Claims, 5 Drawing Sheets

DRAWER STOP DEVICE

FIELD OF THE INVENTION

This invention generally relates to a hardware device for cabinetry, and more particularly, a drawer stop device for preventing scratching of cabinet doors by sliding drawers.

BACKGROUND OF THE INVENTION

Sliding drawers are commonly built into kitchen cabinets, desks, dining room cabinetry, office furniture, and the like to provide more convenient access to storage space therein. Typically, the drawers are mounted behind cabinet doors which serve to close off and provide a clean, finished, external appearance when the cabinet is not in use. When access into the cabinet is desired, the doors are swung open to a position perpendicular or obtuse to the front plane of the cabinet, clearing the opening to allow a drawer to be slid out from the interior of the cabinet.

However, if the doors are not fully opened, or if they swing back, it often happens that when the drawers are pulled out, their front edges bump against and scratch the inside surface of the doors. This is especially bothersome if the cabinet doors are made of expensive wood or a custom finish. Also, if a drawer is not returned to its fully retracted position, an attempt to close the cabinet doors can cause the doors to bump against the protruding front edges of the drawers. After repeated use, scratch lines and other marks can become gouged into the doors and create an unsightly appearance which is difficult to restore.

SUMMARY OF THE INVENTION

In accordance with the present invention, a drawer stop device is provided for use in combination with a sliding drawer mounted in a cabinet behind a front door vertically hinged to one lateral side of the cabinet. The door is movable between a closed position in which the door covers a front opening of the cabinet and hides the drawer therein when it is slidingly retracted to a retracted position into the interior of the cabinet, and a fully open position which allows clearance for the drawer to be slidingly extended out through the front opening of the cabinet. The sliding drawer has a front panel horizontally elongated with opposite ends spaced apart by a given width, a bottom panel, and opposed side walls which are fixed together in an open quadrangular shape defined with opposite vertical front edges. The drawer stop device has a mounting portion fixed to a bearing portion. The bearing portion includes a bearing flange which projects from the mounting portion and a roller element of a given diameter rotatably mounted on a vertical mounting axis defined on an end of the bearing flange. The mounting portion of the drawer stop device is mounted to a portion of the drawer adjacent to one vertical front edge proximate the one lateral side of the cabinet to which the door is hingedly mounted such that the roller element mounted on the bearing portion projects beyond said one vertical front edge of the drawer so that it can make rolling contact with the door ahead of the vertical front edge when the drawer is extended through the front opening of the cabinet.

In a preferred embodiment, the mounting portion is a flat flange lying in one plane and the bearing flange is a flat piece lying in another plane perpendicular to the one plane. The mounting flange is mounted flush on a front surface of the front panel. In the event the drawer is constructed so that the opposite ends of the front panel extend by a small amount of trim laterally beyond the outer side of the side walls, a second drawer stop device of similar construction as the first-mentioned device is mounted to the proximate side wall such that its roller element projects by a predetermined amount beyond said trim of the front panel so that it can make rolling contact with the door ahead of said trim when the drawer is retracted into the cabinet.

In another embodiment, the mounting flange of the drawer stop device is formed as an integral part of a lateral rail mounted to the proximate side wall providing a rail surface on which the drawer slides. The bearing portion is a flat piece lying in a plane perpendicular to the lateral rail. The lateral rail is mounted to the side wall along a bottom part of the drawer, such that the roller element of the drawer stop device projects by a predetermined amount beyond the vertical front edge of the drawer at the bottom part of the drawer.

Other objects, features, and advantages of the present invention will become apparent from the following detailed description of the invention considered in conjunction with the drawings, as follows:

DESCRIPTION OF THE PREFERRED EMBODIMENTS

Figure 1:
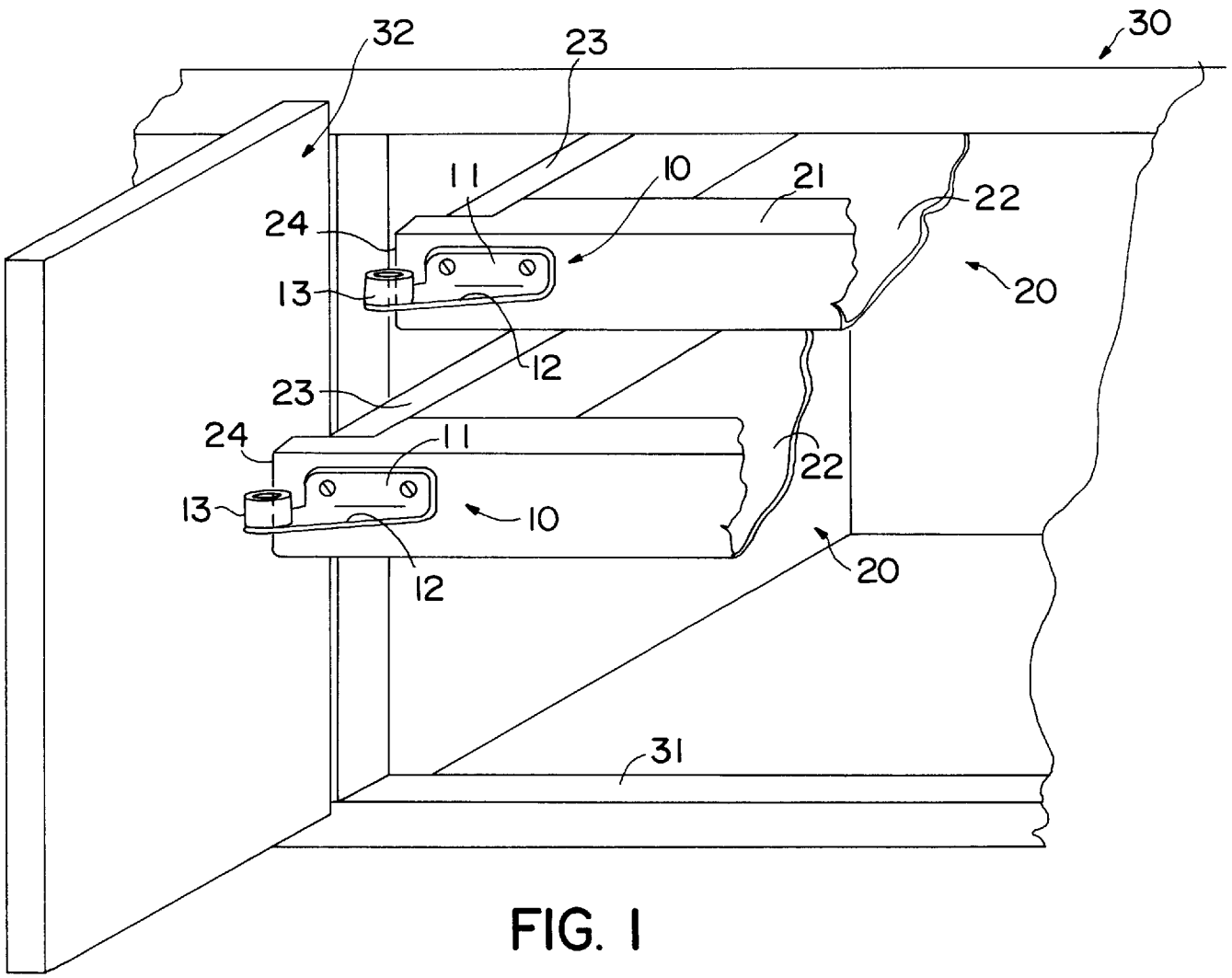
FIG. 1 is a front perspective view showing a drawer stop device mounted to the front panels of the drawers of a cabinet in accordance with the invention.
Figure 2A:
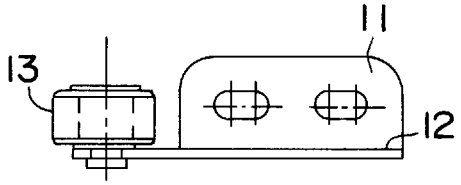
FIGS. 2A, 2B, and 2C are front, side, and plane views, respectively, of a drawer stop device as shown in FIG. 1.
Figure 2B:
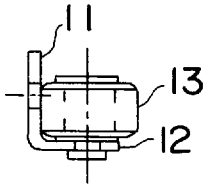
Figure 2C:
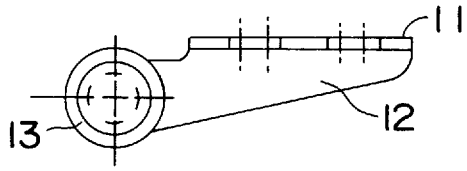

Referring to FIGS. 1, 2A, 2B, and 2C, a preferred embodiment of the drawer stop device 10 of the invention is shown mounted to the sliding drawers 20 in a cabinet 30. The cabinet 30 has a front opening 31 and at least one front door 32 vertically hinged (not shown) to one lateral side of the cabinet. The door 32 is movable between a closed position in which it covers the front opening 31 and hides the drawers 20 when they are slidingly retracted to a retracted position into the interior of the cabinet, and a fully open position (shown in FIG. 1) which allows clearance for the drawers to be slidingly extended out through the front opening 31 of the cabinet.

Each sliding drawer 20 has a front panel 21 horizontally elongated with opposite ends spaced apart by a given width, a bottom panel 22, and opposed side walls 23 which are fixed together in an open quadrangular shape defined with opposite vertical front edges 24. The drawer stop device 10 has a flat mounting portion 11 fixed to a bearing portion 12. The bearing portion 12 includes a bearing flange (also 12) which projects perpendicularly from the mounting portion and a roller element 13 rotatably mounted on a vertical mounting axis defined on an end of the bearing flange 12.

Figure 3A:
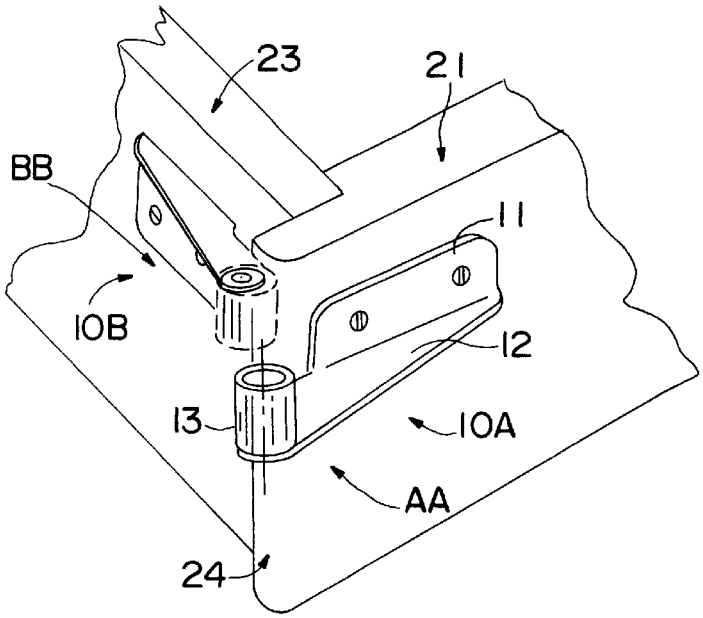
FIG. 3A is a front perspective view of another embodiment in which a paired set of drawer stop devices is mounted to a drawer to rollingly engage a cabinet door in both directions of the drawers sliding movement.
Figure 3B:
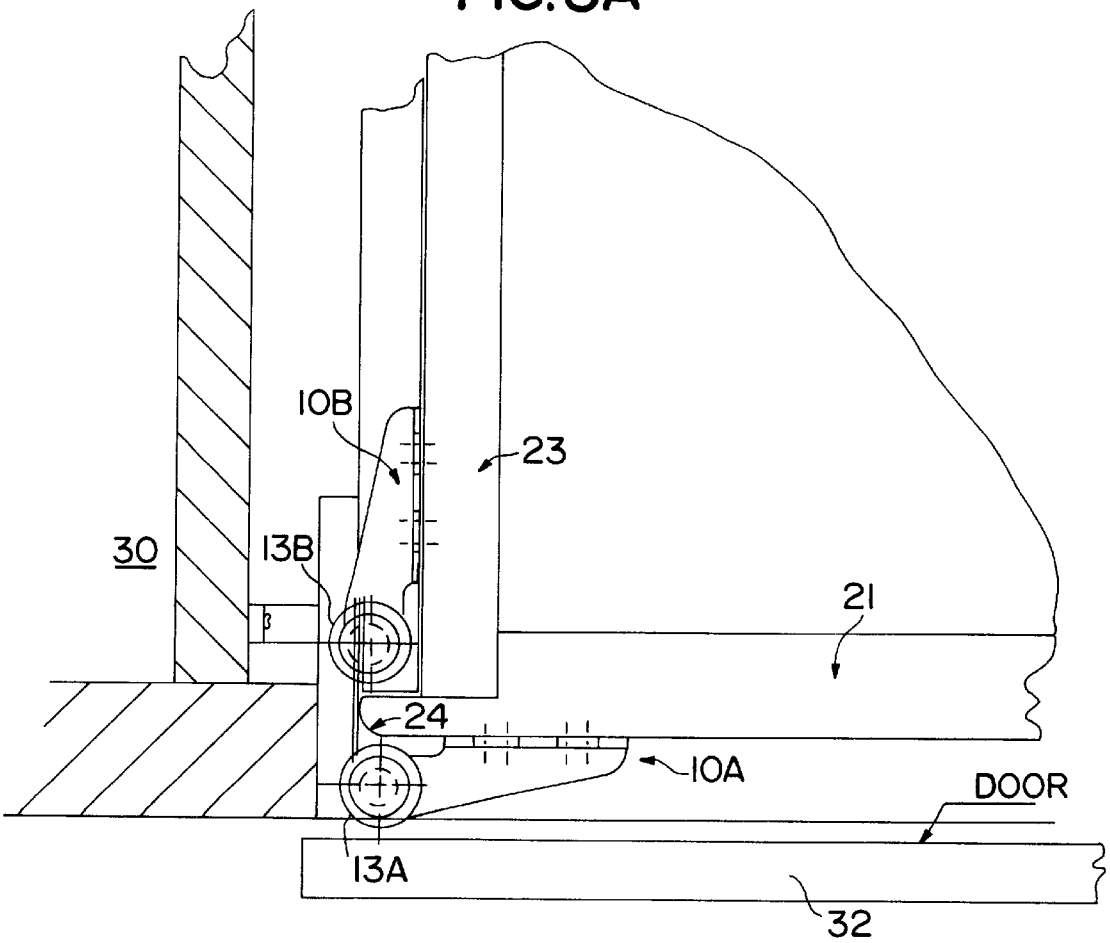
FIG. 3B is a plane view thereof.

As shown more clearly in FIGS. 3A and 3B, the stop device is mounted in one preferred way by fixing its mounting portion 11 to a front surface of the front panel 21 of the drawer (such as with screws or fasteners) adjacent to the one vertical front edge 24 proximate to the one lateral side of the cabinet to which the door is hingedly mounted. The roller element 13 mounted on the bearing portion 12 of the drawer stop device 10 projects by a predetermined amount beyond the vertical front edge 24 of the drawer so that it will make rolling contact with the door just ahead of the front edge 24. When the drawer 20 is pulled outwardly, the roller element 13 engages the door (direction of arrow AA) with a rolling motion which avoids damage to its surface and prevents sharp contact between the drawer and the door. The roller element can also, with sufficient sliding acceleration of the drawer, act to further open the door outwardly.

The drawer stop device typically might have a height for the mounting portion of 0.5 to 0.75 inch, a length for the bearing portion of about 1.5 to 2.0 inches, and a diameter of the roller element of about 0.5 to 0.75 inches. The roller element can be covered or made entirely of a smooth material, such as a hard nylon or plastic material. When mounted in a proper position, the contact surface of the roller element projects a predetermined amount, e.g., about 1.0 inch, so that it makes rolling contact with the door ahead of the vertical front edge of the drawer.

In FIGS. 3A and 3B, a further embodiment has a paired set of drawer stop devices. This configuration is useful where the drawer front panel 21 has ends which extend by a small amount of trim laterally beyond the outer side of the side walls 23. If the drawer has a sliding range which can extend beyond the width of the door, then upon retraction the jutting trim can become wedged by the door or may pinch the fingers of a person holding the front edges of the drawer (direction of arrow BB). Therefore, a second drawer stop device 10B of similar construction as the first-mentioned device referenced as 10A is mounted by its mounting portion 11B on the side wall 23 behind the front panel trim. Its bearing portion 12B mounts a roller element 13B such that it projects by a predetermined amount beyond the lateral extent of the trim of the front panel 21. Upon retraction of the drawer, the front edge of the door would be engaged in rolling contact with the roller element 10B and is pushed outwardly by it so as to allow unimpeded retraction of the drawer into the cabinet.

Figure 4:
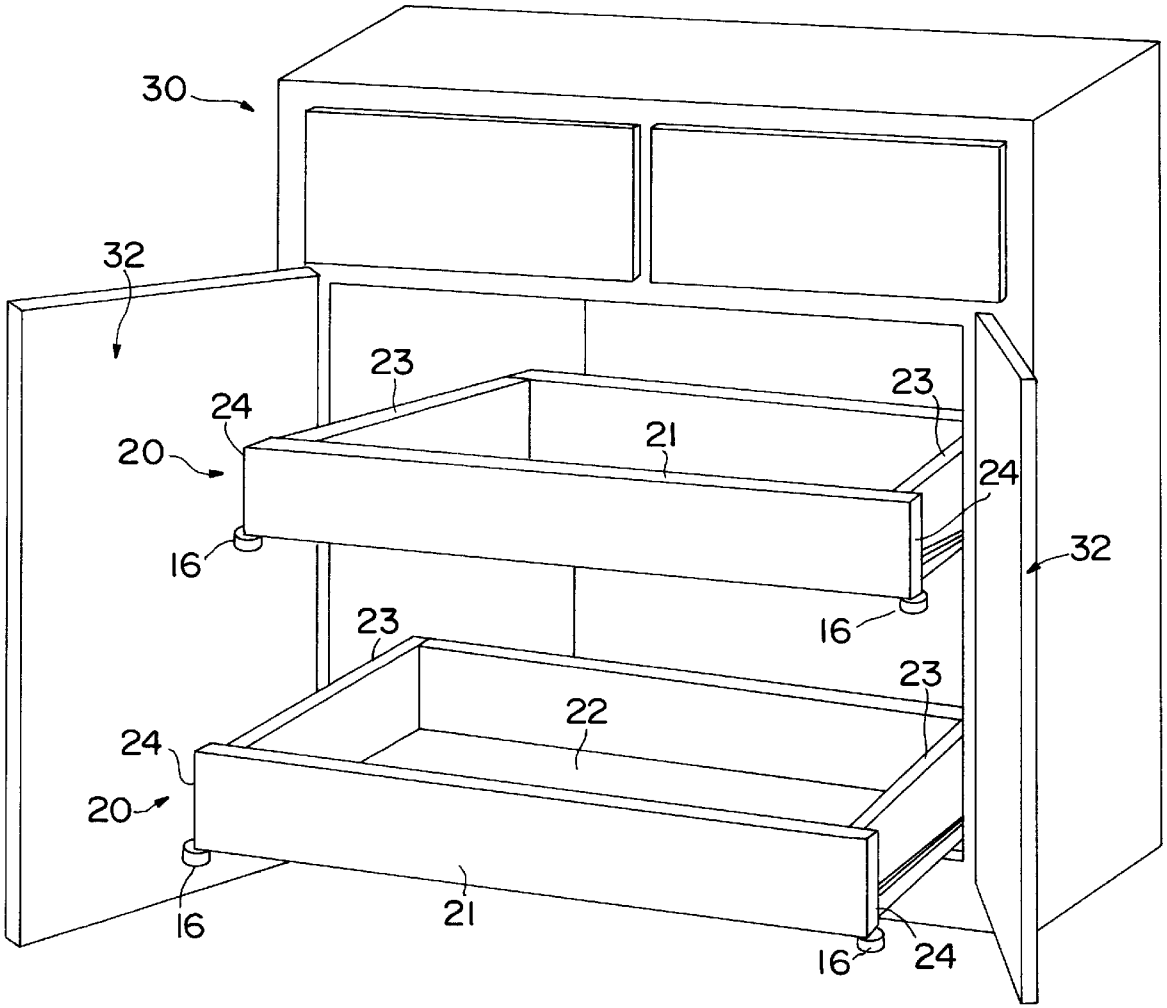
FIG. 4 is a front perspective view showing a further embodiment of the drawer stop device mounted to the bottom part of a drawer of a cabinet.
Figure 5A:
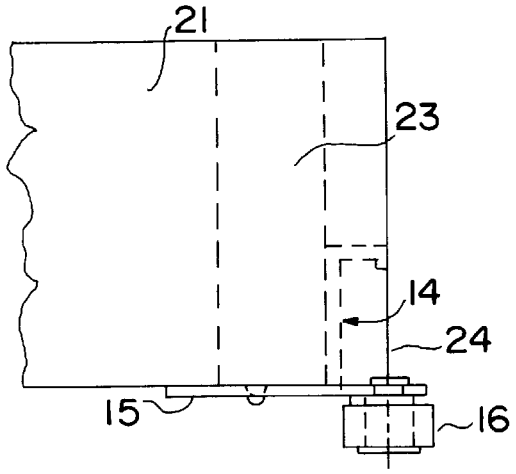
FIGS. 5A, 5B, and 5C are front, side, and plane views, respectively, of a drawer stop device of FIG. 5 mounted to the bottom part of the drawer.
Figure 5B:
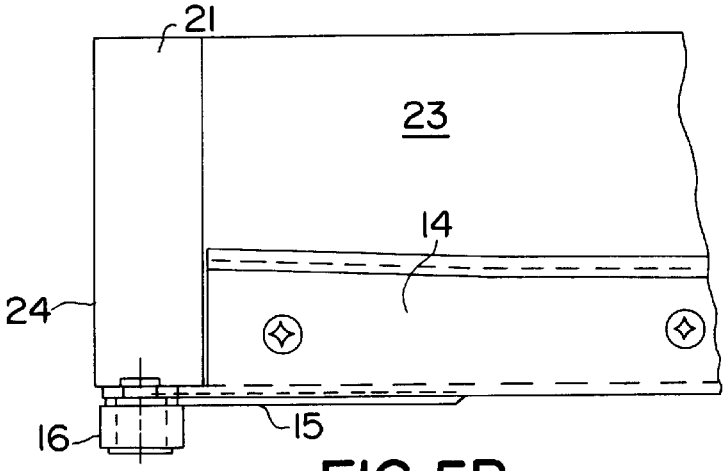
Figure 5C:
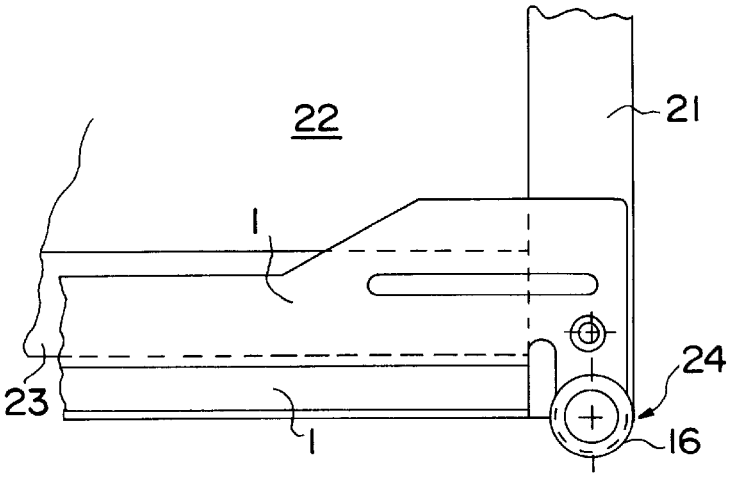

In FIG. 4, another embodiment has drawer stop devices with roller elements 16 mounted on opposite sides at a bottom part of the drawers. As shown in FIGS. 5A, 5B, and 5C, the mounting flange is formed as an integral part of a lateral rail 14 on which the drawer 20 slides, and the bearing portion is a flat piece 15 perpendicular to the lateral rail 14. The lateral rail 14 is mounted on the side walls 23 of the drawer along a bottom part of the drawer. The roller elements 16 are positioned so as to project by a predetermined amount beyond the vertical front edges of the drawers to make rolling contact with the door in the manner described previously.

Numerous modifications and variations may of course be conceived in light of the principles of the invention disclosed herein. All such modifications and variations are intended to be included within the spirit and scope of the invention, as defined in the following claims.

I claim:

1. A drawer stop device in combination with a sliding drawer mounted in a cabinet behind a front door vertically hinged to one lateral side of the cabinet, the door being movable between a closed position in which the door covers a front opening in the cabinet and hides the drawer when the drawer is slidingly retracted to a retracted position in the interior of the cabinet and a fully open position which allows clearance for the drawer to be slidingly extended out through the front opening of the cabinet, the sliding drawer having a front panel horizontally elongated with opposite ends spaced apart by a given width a bottom panel and opposed side walls which are fixed together in an open quadrangular shape defined with opposite vertical front edges, wherein the drawer stop device has a mounting portion fixed to a bearing portion, and the bearing portion includes a bearing flange which projects from the mounting portion, a vertical mounting axis projects from an end of said bearing flange and a roller element is rotatably mounted on said vertical mounting axis, and wherein the mounting portion of the drawer stop device is mounted to a portion of the drawer adjacent to one vertical front edge proximate the one lateral side of the cabinet to which the door is hingedly mounted such that the roller element mounted on the bearing portion projects beyond said one vertical front edge of the drawer so that said roller element can make rolling contact with the door ahead of said one vertical front edge when the drawer is extended out through the front opening of the cabinet and wherein the mounting portion is a flat flange and the bearing flange projects perpendicularly from the mounting flange.

2. A drawer stop device according to claim 1, wherein the mounting flange is mounted on a front surface of the front panel adjacent said one vertical front edge.

3. The drawer stop device in combination with the sliding drawer mounted in said cabinet behind said front door vertically hinged to one lateral side of the cabinet according to claim 1, wherein the opposite ends of the front panel of said sliding drawer extend by a small amount beyond the lateral exterior side of the side walls of said sliding drawer, and a second drawer stop device of similar construction as the first-mentioned device is mounted on the exterior of the lateral side wall closest to where said front door is hinged to said cabinet such that said second roller element projects laterally beyond said front panel so that said second roller element can prevent contact between said door and said sliding drawer when the drawer is retracted back into the front opening of the cabinet.

4. The drawer stop device of claim 1 in which said bearing portion is a single bearing portion.

5. A drawer stop device in combination with a sliding drawer mounted in a cabinet behind a front door vertically hinged to one lateral side of the cabinet, the door being movable between a closed position in which the door covers a front opening in the cabinet and hides the drawer when the drawer is slidingly retracted to a retracted position in the interior of the cabinet and a fully open position which allows clearance for the drawer to be slidingly extended out through the front opening of the cabinet, the sliding drawer having a front panel horizontally elongated with opposite ends spaced apart by a given width, a bottom panel, and opposed side walls which are fixed together in an open quadrangular shape defined with opposite vertical front edges, wherein the drawer stop device has a mounting portion fixed to a bearing portion, and the bearing portion includes a bearing flange which projects from the mounting portion, a vertical mounting axis projects from an end of said bearing flange and a roller element is rotatably mounted on said vertical mounting axis, and wherein the mounting portion of the drawer stop device is mounted to a portion of the drawer adjacent to one vertical front edge proximate the one lateral side of the cabinet to which the door is hingedly mounted such that the roller element mounted on the bearing portion projects beyond said one vertical front edge of the drawer so that the roller element can make rolling contact with the door ahead of said one vertical front edge when the drawer is extended out through the front opening of the cabinet and wherein the mounting portion is a flat flange and the bearing flange projects perpendicularly from the mounting flange.

* * * * *